United States Patent [19]

Giuliani

[11] Patent Number: 4,811,464

[45] Date of Patent: Mar. 14, 1989

[54] PNEUMATIC ASSEMBLY FOR WASTE REMOVAL

[76] Inventor: Marcello Giuliani, Via Cellerese No. 33 50013 Campi Bisenzio, Firenze, Italy

[21] Appl. No.: 99,611

[22] Filed: Sep. 22, 1987

[51] Int. Cl.[4] ..... D01G 15/82

[52] U.S. Cl. ..... 19/107; 19/202

[58] Field of Search ..... 19/107, 202

[56] References Cited

U.S. PATENT DOCUMENTS

| | | | |
|---|---|---|---|
| 1,642,235 | 9/1927 | Fliedner | 19/107 |
| 2,964,804 | 12/1960 | Schonenberger | 19/107 |
| 3,150,415 | 9/1964 | Reiterer | 19/107 |
| 3,943,596 | 3/1976 | Wright et al. | 19/107 X |
| 3,997,936 | 12/1976 | Smith et al. | 19/107 X |
| 4,057,877 | 11/1977 | Gunter | 19/107 |
| 4,079,483 | 3/1978 | Hicks | 19/107 X |
| 4,087,888 | 5/1978 | Tanaka | 19/107 |
| 4,092,764 | 6/1978 | Thomas et al. | 19/107 |
| 4,224,718 | 9/1980 | Hicks | 19/107 |
| 4,245,444 | 1/1981 | Hicks | 19/107 X |

*Primary Examiner*—Louis K. Rimrodt

*Attorney, Agent, or Firm*—Hopgood, Calimafde, Kalil, Blaustein & Judlowe

[57] ABSTRACT

A casing under vacuum located under the carding members has the suction at a position substantially central through an opening developing transversally and interesting almost the whole development of the working front; transversal clefts for the air inlet, at the two ends of the bottom wall of the casing itself, generate along the bottom wall two air blades converging towards the suction transversal opening.

3 Claims, 2 Drawing Sheets

PNEUMATIC ASSEMBLY FOR WASTE REMOVAL

DESCRIPTION

The invention relates to an assembly for the cleaning of the wool and cotton carding machines and for the removal of dust, fibrils and various wastes from the same carding machines, thus avoiding the inconveniences arising from the presence of these wastes and assuring a work continuity that is not obtained in the carding machines at present known. The present-day carding machines provide a suction at one end of the assembly, with a course of the waste which is very long and not easy to be achieved. In these carding machines, the displacement of the waste is obtained by use of compressed air. This causes several inconveniences. First an overpressure is generated in the casing below the cylinders with clothings, and thus the possibility of dispersion of the fibers and other wastes towards the outside. Even if the jets of compressed air—which can be mostly intermittent—on one hand facilitate the removal of the accumulations of wastes, on the other hand they cause dust vortexes along the course of elimination through the suction, thus causing both a dispersion of the dust again towards the material being processed and the working members, and also a dispersion towards the outside with an atmospheric pollution as a consequence.

Systems for the mechanical continuous or periodic removal did not result to be particularly useful.

The present invention avoids the inconveniences of the known arrangements by a system that in addition does not require a particular power consumption and assures a complete cleaning of all members and a systematic removal of wastes with regularity and safety.

Basically, the assembly according to the present invention includes under the carding members a case or casing which defines a chamber with suction means located at its bottom which at a more or less central position thereof has a transverse opening developing transversally and extending substantially across said bottom, said casing being maintained under vacuum by said suction means. Transversely extending clefts or slotted openings are provided for the air inlet at the two ends of the bottom wall of the same casing, in order to generate along said bottom wall two air foils or blades converging towards the central transversal suction opening. The clefts or slotted opening are adjustable, for example like a guillotine. Each cleft is defined by pivotally mounted end wall that can slant or incline around a horizontal axis of a pivot disposed above the bottom wall, in order to change the distance of the lower edge of said end wall from the bottom wall, and thus vary the width of the cleft or slotted opening.

On the flanks or side walls of the casing, openings for the air inlet can be provided, at such positions as to assure the removal of the wastes from the working members, especially from the ends of the drums and cylinders. The two portions into which the bottom wall is subdivided by the transversely extending suction opening are preferably slightly slanted or sloped downwards and towards said opening.

The invention will be better understood by the following the description and the accompanying drawings that show a practical non limitative exemplification of the same invention. In the drawings.

According to what is illustrated in the accompanying drawing, item 1 indicates the assembly for the feeding of the materials to be further processed by the illustrated carding machine. Items 3, 5 and 7 indicate working cylinders with clothings, of any kind known per se, and destined to carry out on the fibers a processing that can allow the output of a web N of fibers, which, suitably drawn in a group 9, gets off to be accumulated or directly sent to the further processing apparatuses. At least the drum 5 is equipped with working cylinders known per se.

Figure 1:
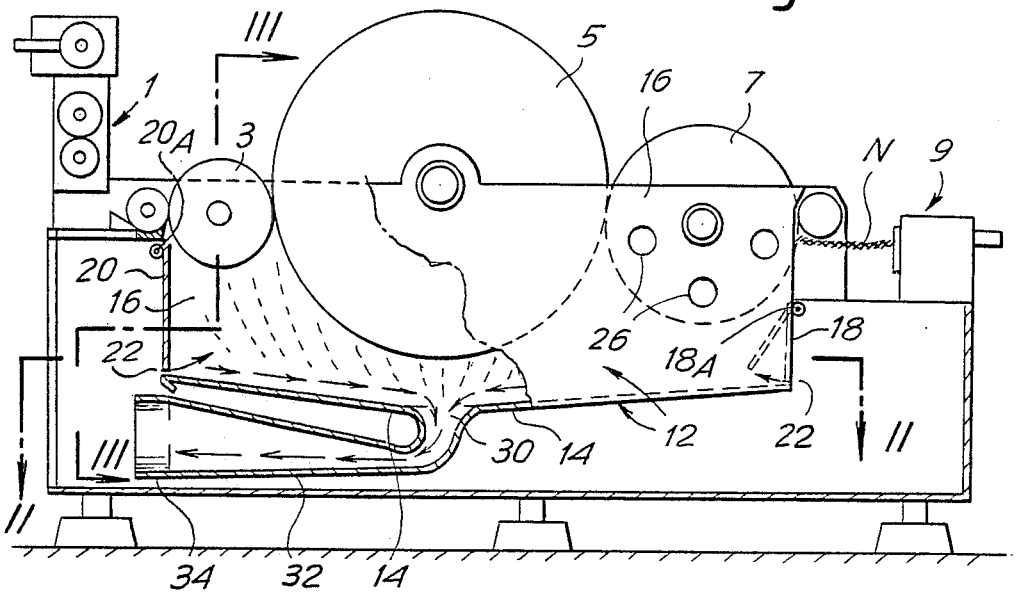
FIG. 1 shows a schematic assembly view of a carding machine equipped with the casing of the assembly according to the invention.
Figure 2:
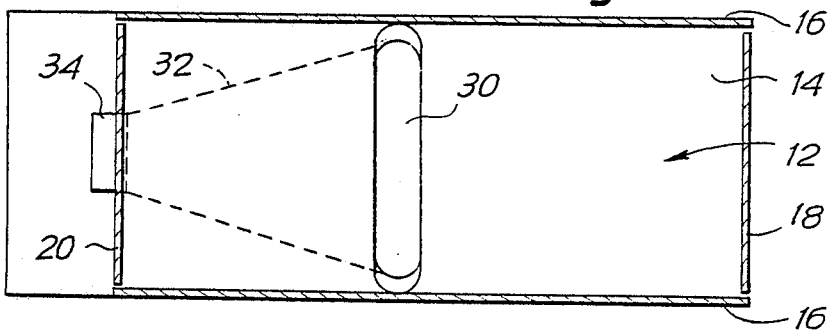
FIG. 2 shows a plan view of the lower portion of the casing, substantially according to line II—II of FIG. 1.
Figure 3:
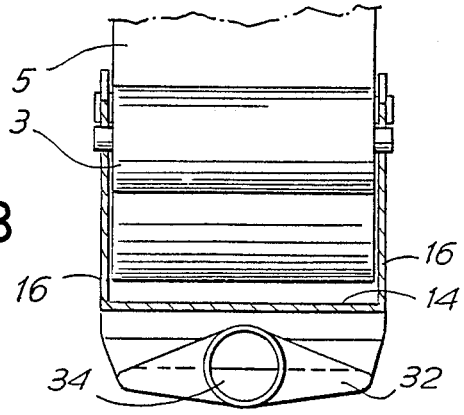
FIG. 3 shows a view basically according to line III—III of FIG. 1.
Figure 4:
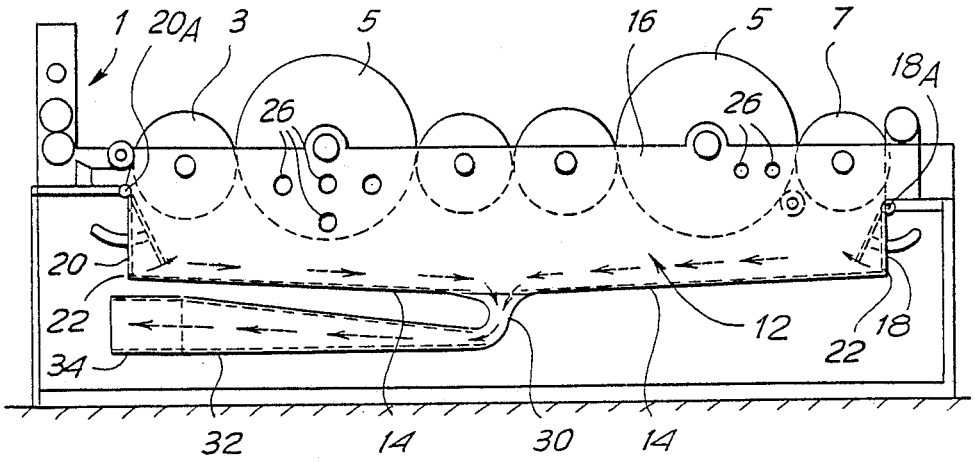
FIG. 4 shows a side view, similar to that of FIG. 1, of a double carding machine.
Figure 5:
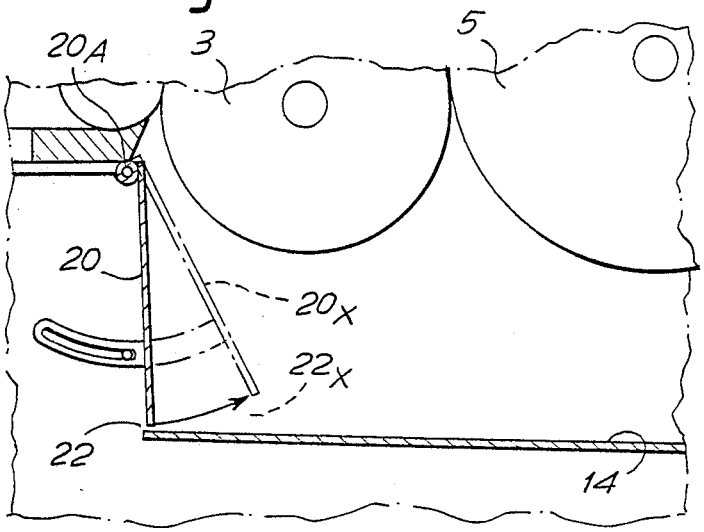
FIG. 5 shows an enlarged detail, in order to show the adjustment possibility of the clefts of air inlet at the ends of the casing bottom wall.

Whatever the realization of the carding machine may be, such as that of FIG. 1 or that of FIG. 4, according to the present invention a casing 12 is provided under the working members such as those indicated by 3, 5 and 7, which casing defines an enclosed chamber which is substantially tight or snug up to the flanks or sides 16 which support said working members so that a vacuum can be formed in the area lying below the working members themselves, wherein the fall by gravity of dust and fibrils and other foreign materials unrelated to the material being processed, takes place. This casing 12 is achieved in practice by two portions 14 of a bottom wall, which are slightly downwardly slanted or sloped towards each other and towards the center of the casing 12; the casing is completed by flanks side walls 16 that are particularly visible on FIGS. 2 and 3, and by end walls 18 and 20 that are in particular movable to define—between their lower bottoms and the portions 14 of the bottom wall—clefts slotted openings 22 developing horizontally and along said portions 14 of the bottom wall and along the whole width of the casing 12 and thus of the working front. In particular the end walls 18 and 20 can be realized at least partially inclinable around articulation axes such as those indicated by 18A and 20A respectively, so that by inclining or pivoting more or less the end wall 18 or 20 a variation of the amplitude that is the width of the clefts or slotted openings 22 is obtained, for example by increasing it in the passage of the end wall 20 from the position shown by continuous line in FIG. 5 up to the position indicated by 20X by hatching to create a cleft 22X larger than the cleft 22.

In the flanks or side walls 16, that graze the bottoms of the cylindrical working members, such as those indicated by 3, 5 and 7, with which the flanks or side walls cooperate to achieve an almost hermetic sealing, openings or passages such as those indicated by 26 can be opened at proper positions, so that suction air streams from the outside are created, when casing 12 is under vacuum, thereby to cause the removal of wastes and dusts from the zones that could tend to keep these wastes during the processing; openings of this kind can be controlled by suitable closing means in order to determine the cleaning function in correspondence to the zones wherein each time a greater formation of accumulations may take place, depending on the processing type being carried out.

The two portions 14 of the bottom wall converge downwardly thereto a transverse opening 30, that develops between the two flanks or side walls 16 and then along the whole working front of the machine, which opening forms a suction aperture that creates the vacuum in the chamber12. This transverse opening 30 has a substantially constant width of any event with a width proportioned so that a substantially uniform suction is assured along the whole transversal front of the casing. The opening 30 is jointed or connected through a funnel shaped portion 32 which extends to a cylindrical suction opening 34, which is associated with an aspirator and a filtering group located upstream or downstream the aspirator, depending on the need.

Apart from the air streams that flow into the casing 12 from the openings 26, it is clear that the two clefts or slotted opening 22 at the ends of the casing and along the portion 14 of the bottom wall cause the formation of an air stream that grazes or flows along the portions 14 and drags all of the dust, fibrils, etc., that accumulate on the portions 14 when the waste material falls from the upper zones of the casing 12, and then from the lower portions of the working members such as those indicated by 3, 5 and 7. Thus a continuous removal of the material takes place, without causing a recycle of the same material, as it happens when pressure means such as pulsating nozzles or other are used; on the contrary by the illustrated arrangement a practically laminar flow of the air streams under vacuum is created and thus a complete elimination of wastes, fibrils and other, which otherwise tend to accumulate within the machine or to scatter within the members of the machine, is obtained. The vacuum existing in the casing 12 and the possibility of creating suitable openings at the most suitable positions assure the cleaning even at zones of the casing and surfaces of the working members that otherwise could be cleaned up only by manual action.

The suction acts centrally, thus dividing the machine into two zones so that the distance of the fall and the course of the fibers—due to the suction—decrease by 50%. The two sheet portions 14 of the bottom wall are slanted or sloped towards the suction, and at the end of the same portions the two adjustable clefts or slotted openings 22 allow an increase or decrease in air speed. These clefts 22 are in close proximity of the slant portions 14, and then the air speed prevents the dust, the discard fibrils and other foreign materials from settling on the sheets: said fibrils and discards go into the flow of the suction air and the zone under the card processing area remains perfectly clean, or any way a timely removal is assured thus avoiding an initial accumulation of wastes and the consequent progressive increase subsequent to said accumulation.

The casing 12 forms a chamber hermetically closed under vacuum. Being the pneumatic removal carried out in a vacuum condition, it is also possible to open other clefts and openings at the critical zones of the area under the card working zone (such as the openings 26) thus determining air flows that provide a radical and complete cleaning also at the sides of all the moving members, of whatever type carding machine used. Being the amount of the clefts limited, the centralized suction causes the increase of the air speed, which air—since it is sucked from the outside—is of use also for cooling all the moving members; the same air also avoids pollution due to the dust that is generated at the zones under the carding machine since all the clefts or slotted openings operate under suction and consequently no particles will go outside the casing, but it will be drawn towards the central suction means 30, 32, 34. All this is anyway achieved by a relatively very limited power consumption.

I claim:

1. The combination with a carding machine for the pneumatic cleaning and removal of fibrils and various waste products in order to avoid the accumulation thereof in wool or cotton carding machines destined for spinning which comprises:

a carding machine characterized by an arrangement of carding members comprising drum and cylinders, and a casing disposed below said arrangement of carding members cooperably associated therewith formed of a bottom wall, side walls and end walls which cooperate to form a substantially sealed chamber within said casing below said arrangement of carding members capable of developing a vacuum therein, each of said end walls being adjustably mounted to provide a slotted opening with said bottom, the size of each of said slotted openings being adjustably varied according to the size required, said bottom wall having a transverse opening located substantially centrally of said bottom and extending substantially across said bottom, said bottom wall converging from each of said end walls towards said transverse opening in a downwardly sloping direction, said transverse opening communicating with a suction member through which fibrils and waste products are removed.

2. The combination as in claim 1, wherein each of said end walls has a top edge and a bottom edge, said top edge being pivotally mounted about a horizontal axis with said bottom edge extending to said bottom wall, each of said end walls being fixedly adjustable about said pivotal mounting to vary the slotted opening between the bottom edge of said end wall and the bottom wall of said casing.

3. The combination as in claim 1, wherein the side walls of the casing are provided with air inlet openings positioned to assure further the removal of fibrils and waste products from the ends of the drums and cylinders of the carding members.

* * * * *